US011319812B2

(12) United States Patent
Lindsey

(10) Patent No.: US 11,319,812 B2
(45) Date of Patent: May 3, 2022

(54) ROTARY PISTON AND CYLINDER DEVICE HAVING A DISH RINGED ROTOR

(71) Applicant: LONTRA LIMITED, Warwickshire (GB)

(72) Inventor: Stephen Francis Lindsey, Warwickshire (GB)

(73) Assignee: LONTRA LIMITED, Southam (GB)

( * ) Notice: Subject to any disclaimer, the term of this patent is extended or adjusted under 35 U.S.C. 154(b) by 85 days.

(21) Appl. No.: 16/329,861

(22) PCT Filed: Sep. 1, 2017

(86) PCT No.: PCT/GB2017/052560

§ 371 (c)(1),
(2) Date: Mar. 1, 2019

(87) PCT Pub. No.: WO2018/042198

PCT Pub. Date: Mar. 8, 2018

(65) Prior Publication Data

US 2019/0218911 A1 Jul. 18, 2019

(30) Foreign Application Priority Data

Sep. 2, 2016 (GB) ..... 1614973

(51) Int. Cl.
*F01C 3/02* (2006.01)
*F01C 19/02* (2006.01)

(52) U.S. Cl.
CPC ..... *F01C 3/02* (2013.01); *F01C 3/025* (2013.01); *F01C 19/02* (2013.01); *F04C 2240/10* (2013.01); *F04C 2240/20* (2013.01)

(58) Field of Classification Search
CPC .. F01C 3/02; F01C 3/025; F01C 19/02; F01C 21/08; F01C 21/104; F01C 21/02;
(Continued)

(56) References Cited

U.S. PATENT DOCUMENTS 2,327,089 A 8/1943 Bejeuhr
6,547,545 B1 * 4/2003 Jonsson ..... F01C 3/02 418/195

(Continued)

FOREIGN PATENT DOCUMENTS

CH 107274 10/1924
CH 276236 10/1951

(Continued)

OTHER PUBLICATIONS

Intenrational Search Report issued in corresponding PCT Application No. PCT/GB2017/052560 dated Aug. 11, 2017.

(Continued)

*Primary Examiner* — Mary Davis
*Assistant Examiner* — Paul W Thiede
(74) *Attorney, Agent, or Firm* — Whiteford, Taylor & Preston, LLP; Peter J. Davis

(57) ABSTRACT

A rotary piston and cylinder device (1) comprising a rotor (2), a stator (4), a rotatable shutter (3), the rotor and the stator comprising surface portions which define a chamber, wherein the rotor comprises a first surface portion (2A) and the stator comprises substantially two surface portions (4*a;* 4*b*'), and the two surface portions of the stator neighbour each other.

12 Claims, 8 Drawing Sheets

(58) Field of Classification Search
CPC ..... F04C 2240/20; F04C 2240/10; F04C 2250/201; F04C 2250/20; F04C 2250/30
See application file for complete search history.

(56) References Cited

U.S. PATENT DOCUMENTS

| | | | | |
|---|---|---|---|---|
| 9,879,534 | B2 * | 1/2018 | Lindsey | F01C 3/02 |
| 2011/0174095 | A1 * | 7/2011 | Lindsey | F01C 3/02 74/63 |
| 2017/0211389 | A1 * | 7/2017 | Lindsey | F01C 19/125 |

FOREIGN PATENT DOCUMENTS

| | | | | |
|---|---|---|---|---|
| EP | 0933500 | A1 * | 8/1999 | F01C 3/02 |
| GB | 2528509 | | 1/2016 | |
| WO | 2010/023487 | | 3/2010 | |
| WO | 2016/012804 | | 1/2016 | |

OTHER PUBLICATIONS

Office Action issued in corresponding Eurasian Application No. 201990477/31 dated Apr. 6, 2020.

* cited by examiner

ROTARY PISTON AND CYLINDER DEVICE HAVING A DISH RINGED ROTOR

TECHNICAL FIELD

The present invention relates generally to rotary piston and cylinder devices.

BACKGROUND

Rotary piston and cylinder devices can take various forms and be used for numerous applications, such as an internal combustion engine, a compressor such as a supercharger or fluid pump, an expander such as a steam engine or turbine replacement, or as another form of positive displacement device.

A rotary piston and cylinder device may be considered to comprise a rotor and a stator, the stator at least partially defining an annular chamber or cylinder space, the rotor may be in the form of a ring or annular (concave in section) surface, and the rotor comprising at least one piston which extends from the rotor into the annular cylinder space, in use the at least one piston is moved circumferentially through the annular cylinder space on rotation of the rotor relative to the stator, the rotor being sealed relative to the stator, and the device further comprising a cylinder space shutter which is capable of being moved relative to the stator to a closed position in which the shutter partitions the annular cylinder space, and to an open position in which the shutter permits passage of the at least one piston, such as by the shutter being rotatably mounted, the cylinder space shutter may be in the form of a shutter disc.

We have devised a novel configuration of a rotary piston and cylinder device.

SUMMARY

According to the invention there is provided a rotary piston and cylinder device comprising a rotor, a stator, a rotatable shutter, the rotor and the stator may comprise surface portions which define a chamber, wherein the rotor may comprise a first surface portion and the stator may comprise or define substantially two surface portions, and the two surface portions of the stator may neighbour or be adjacent to each other.

The two stator surface portions may be major surface portions defining the chamber.

The two surface portions of the stator have different respective orientations (for example relative to the axis of rotation).

The cross-section may be taken on a radial plane, which includes an axis of rotation of the rotor.

Preferably the chamber is substantially defined by three major surface portions, being those as mentioned above.

The surface portions of the stator may comprise adjacent curved and straight portions, when viewed in cross-section.

The surface portions of the stator may be substantially linear in cross-section. At least one of the stator surface portions may be non-linear, curved or dished in cross-section.

The surface portions of the stator, when viewed in cross-section, may be not be substantially orthogonal of each other, and may be orientated at an angle between 0 degrees to 90 degrees, or may be between 50 degrees and 130 degrees, or within a range of 10 degrees to 170 degrees.

Alternatively, the surface portions of the stator, when viewed in cross-section, may be substantially orthogonal of each other.

The surface portions of the stator preferably meet at, or are proximal to each other, at a junction region. The stator portions are preferably connected to each other. The stator surface portions may be viewed as being adjacent each other.

The cross-sectional profiles of one or more of the surface portions of the stator are substantially linear.

The cross-sectional profile of the surface portion of the rotor may be substantially curved.

The surface portion of the rotor may extend from or proximal to a distal region of one of the surface portions of the stator, to, or proximal to, a distal region of the other surface portion of the stator.

When viewed in cross-section the chamber may be termed a three-sided chamber, including three major chamber-defining surfaces.

The cross-section may be taken on a radial plane, which contains the axis of rotation of the rotor.

The surface portions of the stator may comprise an (at least in part) annular surface portion, and a substantially cylindrical surface portion, respectively.

The annular surface portion of the stator may be substantially flat.

The axis of rotation of the rotor may be at an angle which is not orthogonal to the axis of rotation of the shutter. Most preferably the axis of rotation of the rotor and the shutter are not parallel.

The axis of rotation of the rotor may be substantially orthogonal to the axis of rotation of the shutter.

The stator may comprise a structure which substantially accommodates or contains or packages the rotor and the shutter. The stator may comprise two parts or sub-assemblies which, when connected together, collectively enclose the rotor and the shutter. The stator may in whole or in part enclose the rotor.

The annular chamber may be termed an annular, or circular, working cylinder or space.

The term 'piston' is used herein in its widest sense to include, where the context admits, a partition capable of moving relative to a cylinder wall, and such partition need not generally be of substantial thickness in the direction of relative movement but can be in the form of a blade. The partition may be of substantial thickness or may be hollow. The piston may form a partition within the cylinder space. The piston may be arranged to rotate, in use, around the axis of rotation of the rotor.

Although in theory the shutter could be reciprocable, it is preferred to avoid the use of reciprocating components, particularly when high speeds are required, and the shutter preferably comprises one or more shutter discs which is arranged to be positioned substantially in register with the circumferentially- or circularly-extending bore of the annular cylinder space, and is provided with at least one aperture which in the open condition of the shutter permits passage of the at least one piston therethrough.

The rotor and stator may define a working chamber. A surface of the rotor which in part defines the working chamber may be concave or curved in cross-section. The working chamber may be of substantially annular form.

The shutter may present a partition which extends substantially radially of the cylinder space.

The at least one aperture of the shutter may be provided substantially radially in, and with respect to, the shutter.

Preferably the piston is so shaped that it will pass through an aperture in the moving shutter, without balking, as the aperture passes through the annular cylinder space. The piston may be shaped so that there is minimal clearance between the piston and the aperture in the shutter, such that a seal is formed as the piston passes through the aperture. A seal may be provided on a surface or edge region of the first side portion of the piston. In the case of a compressor the first side portion provides a leading surface and in the case of an expander the first side portion provides a trailing surface.

The term 'seal' is used throughout this text in its widest sense to include allowance for an intentional leak path of fluid, by way of a close-spacing between opposed surfaces, and not necessarily forming a fluid-tight formation. Within this scope a seal may be achieved by way of close-running surfaces or a close-running line or a close-running region. The seal may be provided by a sealing gap between opposing surfaces, to minimise or restrict transmission of fluid therethrough. The sealing gaps corresponding to different surfaces may have varying clearances to their respective opposing parts, due to different assembly and operational requirements.

The rotor is preferably rotatably supported by the stator rather than relying on co-operation between the piston and the cylinder walls to relatively position the rotor body and stator. It will be appreciated that a rotary piston and cylinder device is distinct from a conventional reciprocating piston device in which the piston is maintained coaxial with the cylinder by suitable piston rings which give rise to relatively high friction forces.

The seal between the rotor and the circumferential surface of the shutter disc may be provided by a sealing gap therebetween, which is arranged to minimise transmission of fluid.

The rotor may be rotatably supported by suitable bearing means carried by the stator.

Preferably the stator comprises at least one inlet port and at least one outlet port.

At least one of the ports may be substantially adjacent to the shutter.

Preferably the ratio of the angular velocity of the rotor to the angular velocity of the shutter disc is 1:1, although other ratios are possible.

The shutter may be arranged to extend through or intersect the cylinder space at (only) one region or location of the cylinder space.

The rotor may comprise a (circular) concave or curved surface which defines, in part, with the stator, the annular chamber. The surface of the rotor which in part defines the cylinder space may be of dished or bowled, shape or configuration.

At least one of the chamber-defining stator surfaces may be radially inward of the rotor.

The piston may extend from the rotor surface generally towards an axis of rotation of the rotor, or what may be described as extending inwardly of the device. The rotor surface is radially outward of the piston. Alternatively, the piston may extend from the rotor surface generally away from an axis of rotation of the rotor, or what may be described as extending outwardly of the device. The rotor surface may be radially inward of the piston.

The rotor surface may be asymmetrical with respect to a plane substantially perpendicular to the axis of rotation of the rotor, which plane extends through a mid-region of the rotor surface, and the rotor surface may be directed generally away from the axis of rotation of the rotation of the rotor.

The mid-region may be located substantially equidistant between (axial) end portions of the rotor surface, preferably with respect to the axis of rotation of the rotor.

The rotor surface may be viewed as being angularly offset from the perpendicular plane. The angular offset may be substantially 45 degrees from the plane, 55 degrees, or may be in the range 30 degrees to 60 degrees or in the range 40 to 50 degrees.

The rotor surface may present a facing angular orientation which is angularly intermediate of the perpendicular plane and a second plane which is orthogonal thereto which includes the axis of rotation.

At least one of the chamber-defining stator surfaces may be radially outward of the rotor.

The device may comprise a rotational shaft and with which the rotor may be attached or integral with and may extend around the shaft. The shaft may extend from at least one axial end of the rotor. The shaft may comprise two shaft portions, which each extend away from a respective axial end of the rotor. The shaft may comprise a unitary component which is arranged to extend through the rotor. The rotor may comprise a central opening through which a rotational shaft can be located.

The shaft may provide for rotational input and/or output to the device.

A rotational bearing may be provided axially spaced from the annular chamber. At least two rotational bearings may be provided axially spaced from the annular chamber and from each other, and arranged such that the annular chamber is intermediate of the bearings.

The rotor surface may be of generally flared profile, preferably when viewed in axial cross-section. The rotor surface may extend between a first rotor surface end region and a second rotor surface end region, and the first rotor surface end region being spaced along the axis of rotation of the rotor with respect to the second rotor surface end region, and one of the rotor surface end regions having a greater radial extent than the other end region. Each of the end regions may be located at the distal or extreme region of the rotor surface, with respect to the axis of rotation.

The rotor surface may be at least one of continuous, smooth and curved.

The device, and any feature of the device, may comprise one or more structural or functional characteristics described in the description below and/or shown in the drawings, either individually or in combination.

BRIEF DESCRIPTION OF THE DRAWINGS

Various embodiments of the invention will now be described, by way of example only, with reference to the following drawings in which.

DETAILED DESCRIPTION

Reference is made to the Figures which show various embodiments of a rotary piston and cylinder device of the type which comprises a rotor, a stator, and a rotatable shutter, and can be adapted for various operational guises. The stator and the rotor comprise surface portions which define a (generally) annular chamber through which a piston attached to the rotor passes. The shutter provides a partition in the chamber, and has a slot which allows the piston to pass therethrough, without baulking. In the described embodiments which follow particular mention is made to the advantageous geometrical characteristics of the working chamber.

Figure 2:
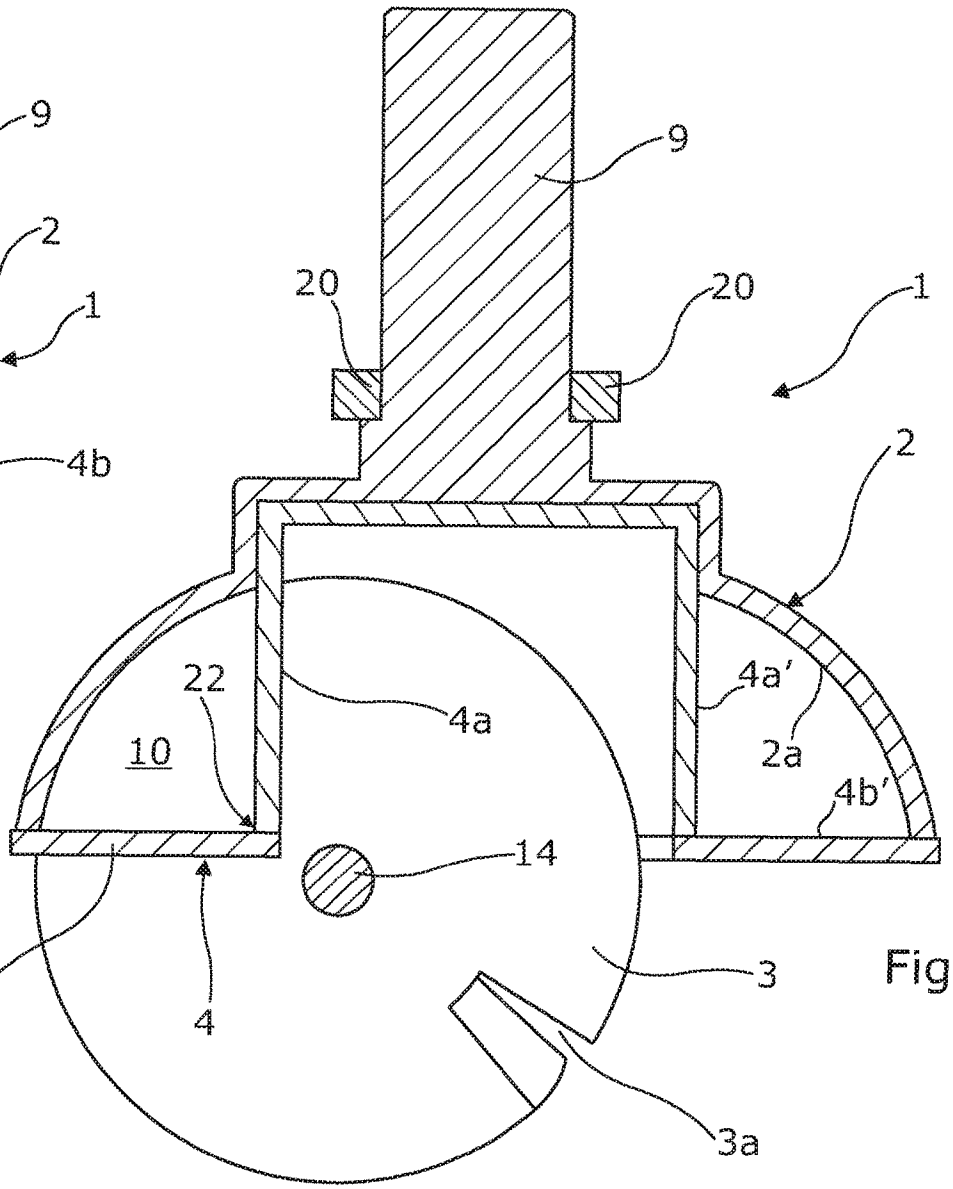
FIG. 2 is an axial cross-section of the rotary piston and cylinder device in FIG. 1.
Figure 1:
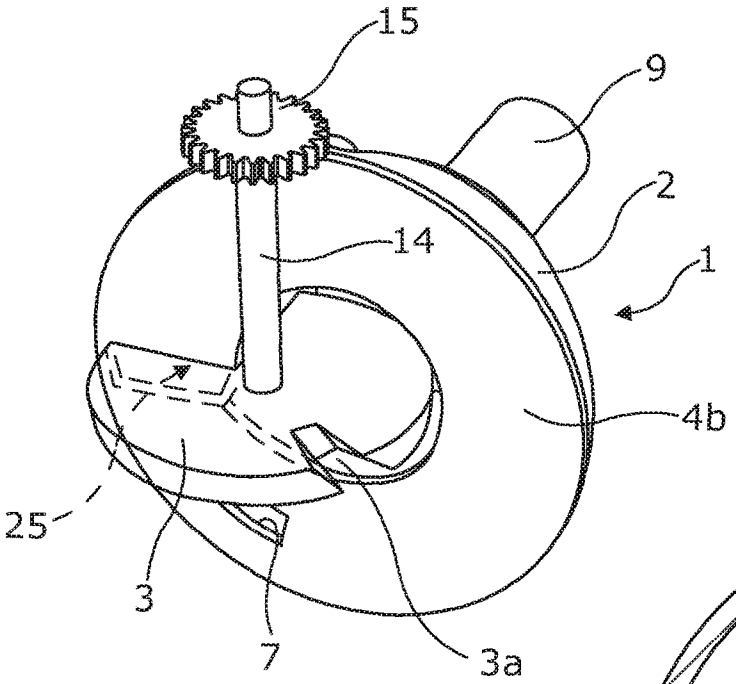
FIG. 1 is a perspective view of a rotary piston and cylinder device of a first type.

Turning first to FIGS. 1 and 2, there is shown a rotary piston and cylinder device 1 of a first type, which comprises a rotor 2, a stator 4 and a shutter disc 3. FIG. 1 shows a stator of a rotary piston and cylinder device. The stator 4 comprises what may be termed an inner stator and an outer stator. The inner stator 4*a* is of substantially cylindrical form and defines an outer surface 4*a*'. The outer stator 4*b* is of substantially annular form and defines an inwardly facing surface 4*b'*.

The stator 4 further comprises a slot 25 which is provided to receive the shutter 3, to divide the annular chamber, or cylinder space, 10 defined by the above mentioned surfaces of the rotor and the stator.

A transmission assembly is provided to synchronise the rotation of the rotor 2 and the shutter 3. The transmission assembly comprises a shaft 14 and a toothed gear 15. Further gears (not shown) comprising a gearbox, or another means of transmission, can connect the toothed gear to the shaft 9, which thereby ensures that the shutter 3 rotates in synchrony with the piston.

A port 7 is provided in the outer stator 4*b*. Other ports may also be provided in the stator or in addition to the port 7.

Figure 3:
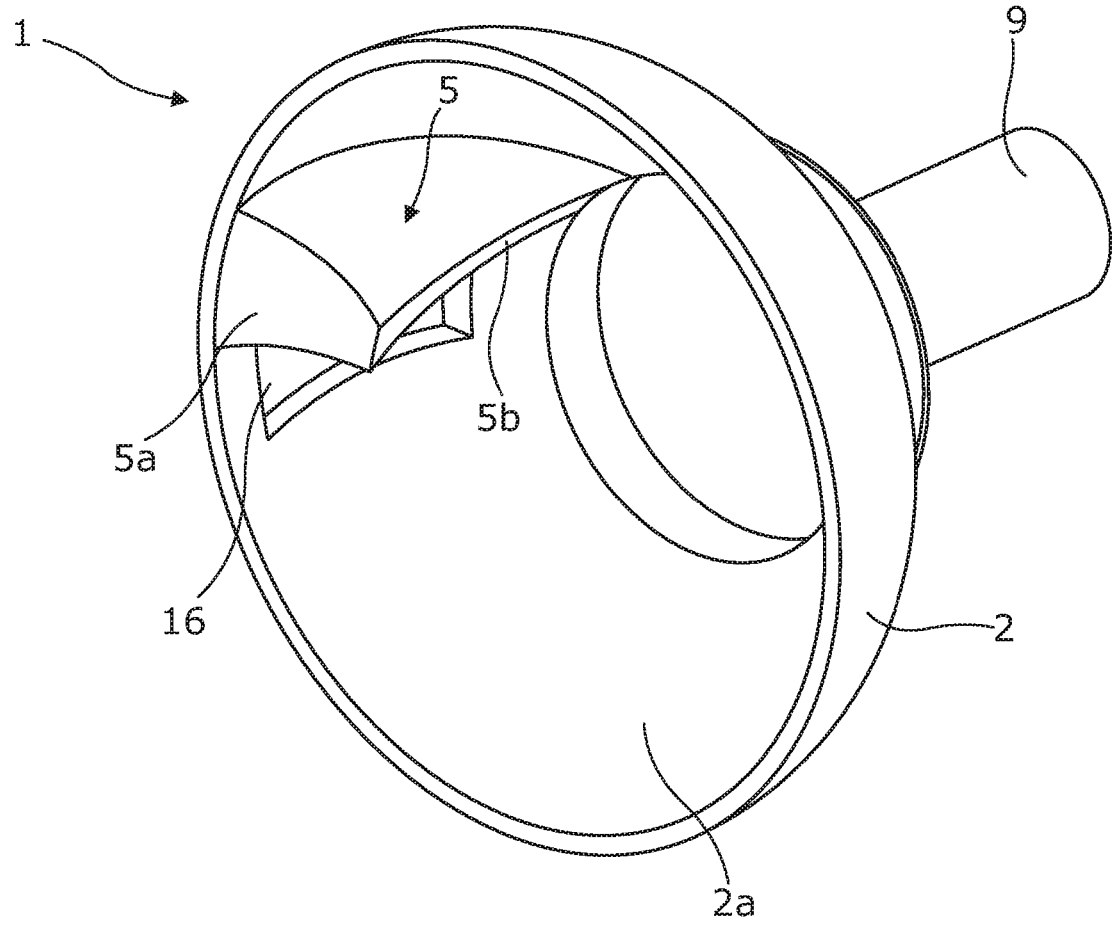
FIG. 3 is a perspective partial view of the rotor of the rotary piston and cylinder device of FIG. 2.

FIGS. 2 and 3 shows the rotor 2, which comprises a dished or concave ring. The rotor 2 fits over the inner stator 4*a* to define an annular cylinder space 10. The rotor 2 is provided with a fluid port 16. The port 16 can correspond with a further port in a stator portion (not shown) which is located on the radially opposite side of the rotor to the annular cylinder space or working chamber 10, which comprises a structure arranged to be outermost of both the stator and the rotor, to form a valved port. Alternatively, another form of valving or porting may be used.

Alternatively further ports in the rotor 2 or in the additional stator portion, described above, may be employed.

In FIG. 3 it can be seen that the rotor 2 comprises piston 5. The piston is shaped so that it will pass through the slot 3*a* of the shutter, without bulking, and forming a seal therewith. The piston 5 comprises side surfaces 5*a* and 5*b*. The surface 5*a* opposes the surface 4*b* of the stator and forms a seal therewith, and the surface 5*b* opposes the surface 4*a*, and forms a seal therewith. By 'seal' we include allowance for a leak path of fluid, by way of the (close) spacing between opposing surfaces, and not necessarily forming a fluid-tight seal. For example, a seal may be achieved by way of a close-running line or close-running region between opposed moving surfaces.

The chamber 10, as seen in FIG. 2, comprises the curved rotor surface 2*a*, and the two stator surfaces 4*a*' and 4*b*'. As can be seen, in cross-section, the stator surfaces 4*a*' and 4*b*' can be non-curved and linear. Said stator surfaces 4*a*' and 4*b*' are arranged substantially orthogonally to each other, and meet at a junction region. Both of the chamber-defining stator surfaces 4*a*' and 4*b*' can be said to be located generally radially inwardly of the rotor 2. The chamber 10 may be referred to as a three-sided chamber, and has benefits which include:

Reduced manufacturing/inspection costs due to the presence of only one junction region on the stator The surface area/volume ratio of the chamber is reduced to thereby advantageously maximise the volume available for use in the chamber.

In more detail, for a given rotor 2, the linear cross-sections of 4*a* and 4*b*' can be made possible by the relocation of the first transmission gear 15 away from the shutter disc 3. This is the first gear of the transmission means which synchronises the rotation of shutter disc 3 to rotor 2. Whereas in known devices it was located close to shutter disc 3 to reduce package size and shaft stiffness requirements, this can make it difficult to also have the linear surfaces 4*a*' and 4*b*' that enable a larger/maximised working chamber 10, and hence greater volumetric capacity of the device. Moving the first transmission gear to a position substantially outside the working chamber 10 and of the device in general allows for a larger swept volume 10, but also increases the length of the transmission (lower transmission stiffness, potentially greater backlash if more gears are required), and bulk of the overall machine. This means that the present invention can be more suitable, but not limited, to smaller machines.

Easier assembly of the device is facilitated since the inner stator is not necessarily required to locate on another curved surface of the piston 5, as would be the case if the chamber were defined by an additional curved surface interface (between stator 4 and piston 5). Rather than resting the inner stator on said curved surface, it can rest on the flat surface 4*b*' of the outer stator 4*b*. Radial alignment is achieved by the mating cylindrical surfaces 4*a*' and cooperating surface of the rotor. This effectively removes the need to control and adjust an extra clearance as part of the assembly process.

Figure 4:
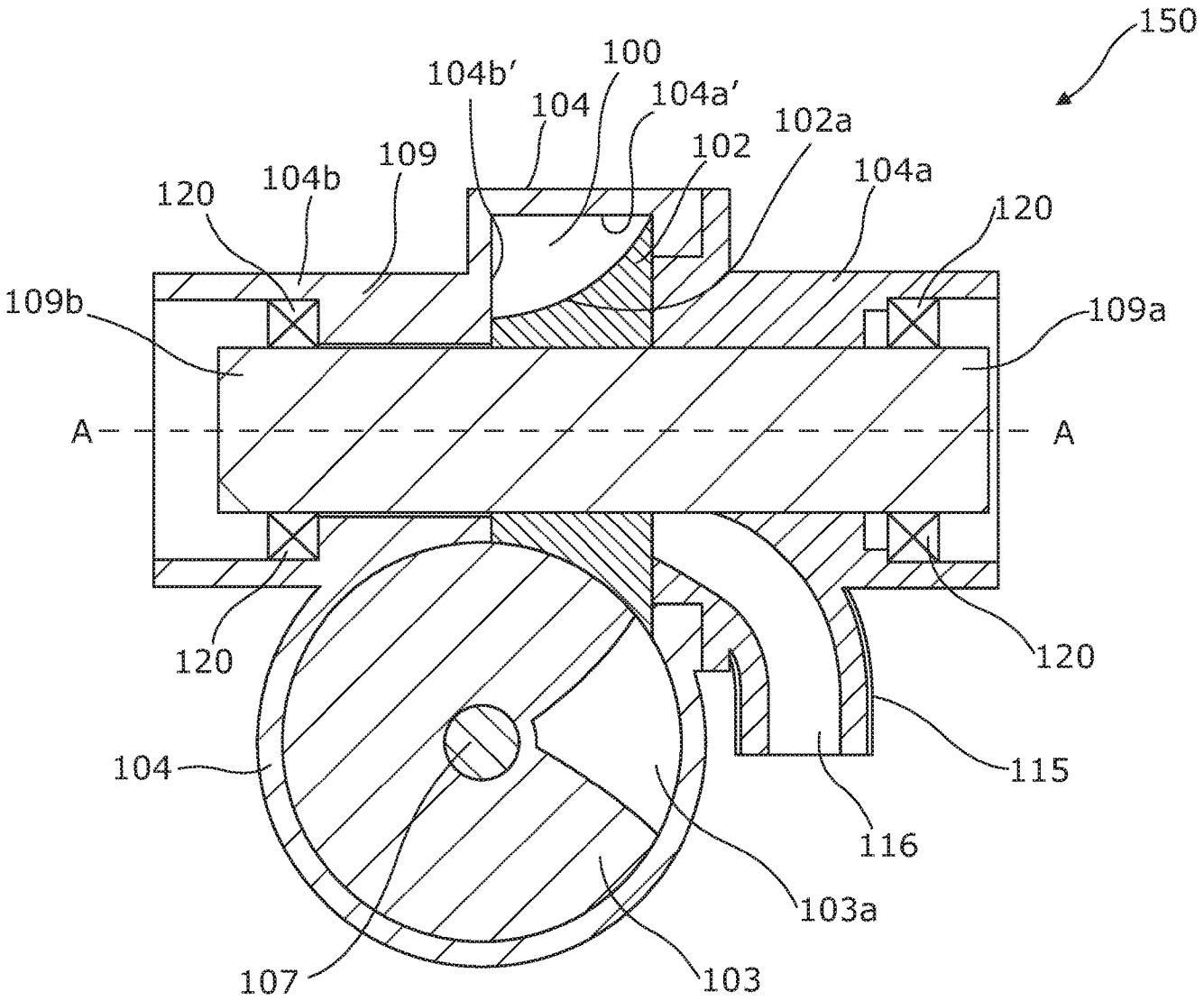
FIG. 4 is an axial cross-sectional view of a second type of rotary piston and cylinder device.
Figure 5:
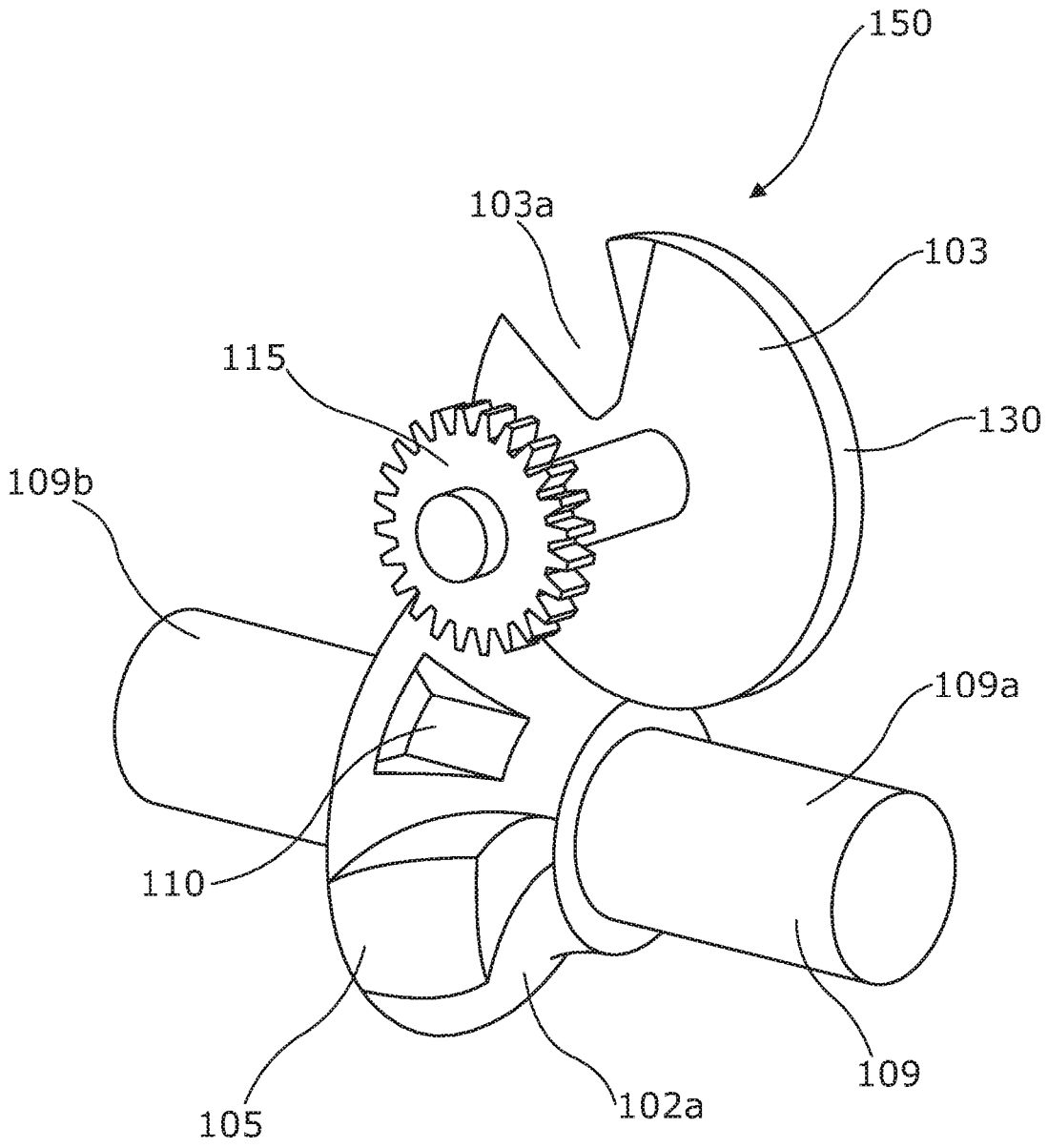
FIG. 5 is a perspective partial view of the device of FIG. 4.

Turning now to FIGS. 4 and 5, there is shown a rotary piston and cylinder device 150 of a second type, comprising a rotor 102, a stator 104, and a shutter disc 103. The rotor 102 is mounted to rotate about an axis of rotation A-A. The stator 104, comprises formations 104*a* and 104*b*, such as a housings or casings, which are maintained relative to the rotor, and internal surfaces 104*a*' and 104*b*' of the stator facing a surface 102*a* of the rotor, together define an annular cylinder space or working chamber, shown generally at 100. The surface 104*a*' can be described as being part of a substantially cylindrical portion of the stator, and the surface 104*b*' can be described as being part of an annular end of the cylindrical portion. As can be seen, the two stator surfaces 104*a*' and 104*b*' are arranged substantially orthogonally to each other, when viewed in cross-section. It will be appreciated that the cross-section is taken on a radial plane, which includes the axis of rotation of the rotor A-A.

Integral with or attached to the rotor and extending from the surface 102*a* there is provided a piston 105. A slot or opening 103*a* provided in the shutter disc 103 is sized and shaped to allow passage of the piston therethrough. Rotation of the shutter disc 103 can be geared to the rotor by way of a transmission means which may comprise gearing and which is arranged to ensure that the rotation of the rotor remains in synchrony with the rotation of the shutter disc. A possible geared component of the transmission means is shown by toothed gear 115. The shutter disc 103 is rotationally mounted by way of shaft 107 which may comprise portions on one or both sides of the shutter disc.

In use of the device, a circumferential surface 130 of the shutter disc faces the surface 102*a* of the rotor so as to provide a seal therebetween, and so enable the shutter disc to functionally serve as a partition within the annular cylinder space.

The geometry of the surface 102*a* of the rotor can be governed by the circumferential surface 130 of the rotating shutter disc.

The rotor and the stator are configured to provide the annular cylinder space with one or more inlet ports and one or more outlet ports for the working fluid. One of the ports is described in more detail below.

With reference in particular to FIG. 5, there is shown a perspective view of the rotor and shutter arrangement, excluding the stator or housing (for ease of representation). As can be seen in both views, there is provided a shaft 109, which comprises end portions 109*a* and 109*b*, which extends through the rotor 102. To achieve this arrangement, the rotor 2 is provided with a central through-hole (not referenced). Advantageously, during assembly of the device, the rotor can be slid onto the shaft 109. The rotor 102, with the shaft in position in an assembly process, is then arranged to be fast with the shaft. The rotor 102 is located intermediate of the end portions 109*a* and 109*b*. Depending on the particular operational application of the device 150, the shaft may be used to provide rotational input or output.

As is evident, since the piston 105 is of relatively wide dimension, the opening 103*a* of the shutter 103 must be accordingly proportioned, in order to allow the piston to pass through the opening. It will be appreciated, and is to some extent evident in the drawings, that the boundary of the opening 103*a* is suitably configured/profiled, to take account of the relative movement between the piston and the shutter disc.

The rotor 102 is provided with a port 110 which extends from the surface 102*a* through to the opposite, or what could be termed 'rearward' surface of the rotor.

As will be described further below, this conveniently allows for fluid to flow into or out of the annular working chamber of the device, for example compressed fluid.

With reference to FIGS. 4 and 5, depending from the part 104*a*, there is provided a formation 115. This feature provides a port, such as an outlet port, for working fluid from the device. The formation 115 comprises an opening, and the innards of the part 104*a* are configured to include a conduit or passageway 116 which communicates with the opening. The above described port 110 of the rotor 102 is arranged to periodically come into register with the passageway 116. As the rotor 102 rotates and the port 110 comes into alignment with the passageway 116 allowing continuous passage for fluid to flow into or out of the annular working chamber 100.

During assembly or manufacture of the device 150, the parts 104*a* and 104*b*, can be rigidly attached together by way of fasteners or by other means The shaft 109 is rotatably mounted by bearings 120 is arranged to rotate about the rotational axis A-A. As alluded to previously, in addition to the porting provided by the passageway 116, typically providing an outlet port in a compressor arrangement, formed in the stator 104, there is also provided a port (not illustrated) which provides an inlet for working fluid. In use, a transmission between the rotor and the shutter ensures the required synchronisation therebetween. If the device 150 is used as a compressor, a suitable motive or drive source can be attached to an end portion 109*a* or 109*b* of the shaft 109.

Figure 6:
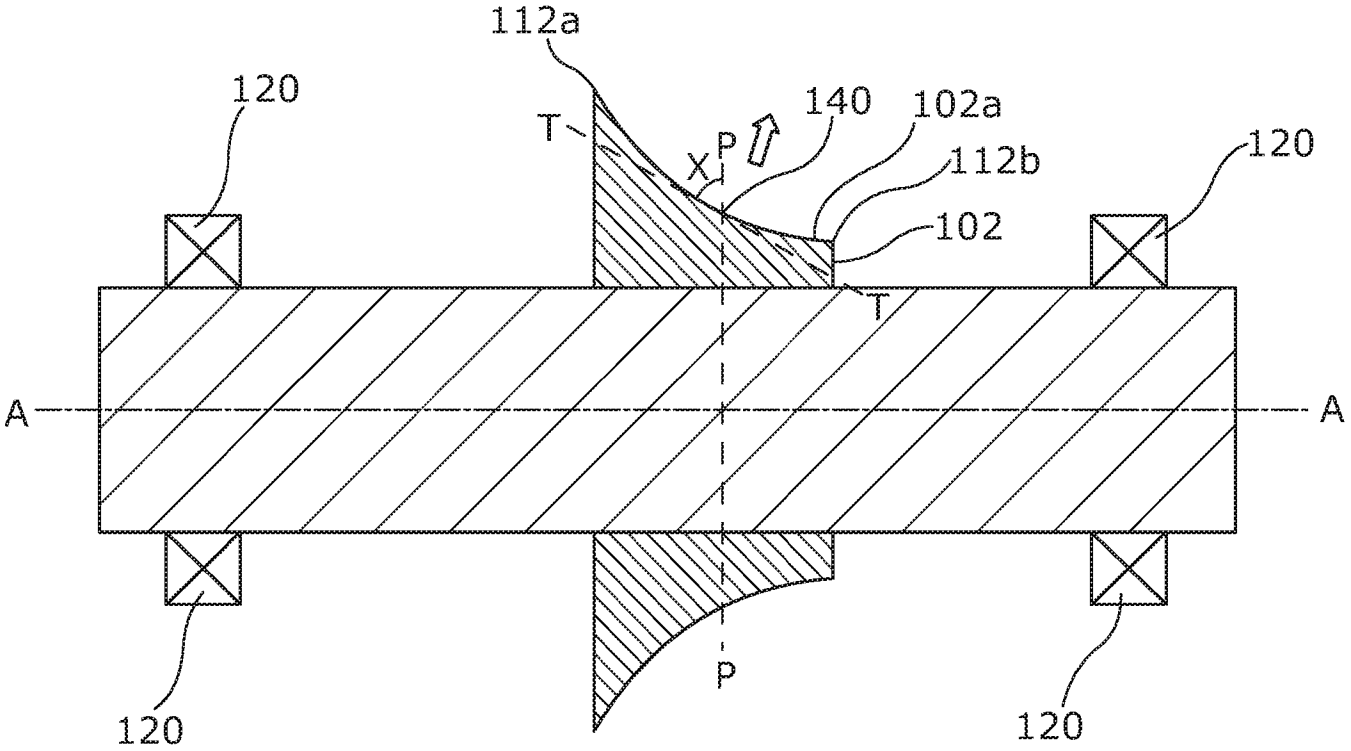
FIG. 6 is an axial partial view of the rotor of the device of FIG. 4, and FIGS. 7 to 9 are axial cross-sections of further embodiments of the present invention in devices of the first type.

FIG. 6 serves to illustrate the geometric characteristic of the rotor 102 of the device 150. The surface 102*a* of the rotor 102 may be described as being asymmetric, or as being orientated at an incline. This asymmetry is with respect to a plane P-P, which extends through and bisects the rotor 102, at its mid-point 140. Its mid-point may be described as that which is midway between the distal end portions 112*a* and 112*b*, which define and bound the axial extent of the surface 102*a*. The plane P-P is also orthogonal to the axis of rotation A-A. It can be seen that the concave or curved in cross-section surface 102*a* is asymmetrical about the plane P-P. The rotor surface itself, as indicated by the arrow, faces generally away and outwardly of the axis of rotation A-A. A measure of the angle of orientation can be determined by taking a tangent T at the point of intersection between the plane P-P, and the rotor surface 102*a*. It is thereby possible to determine an angle of orientation x between the tangent line T-T and the plane P-P. This angle is substantially 55 degrees.

Other angles are possible, for example the angle could be between 20 and 70 degrees, or between 30 and 60 degrees.

The transmission toothed gear 115 is spaced from the shutter disc 103, and this thereby allows a larger/maximised working chamber 100 (as can be seen from the modified opening 103*a*' and piston 5), having the three sides 104*a*, 104*b* and 102*a*, on the same conceptual basis as described in relation to the above embodiments.

Figure 7:
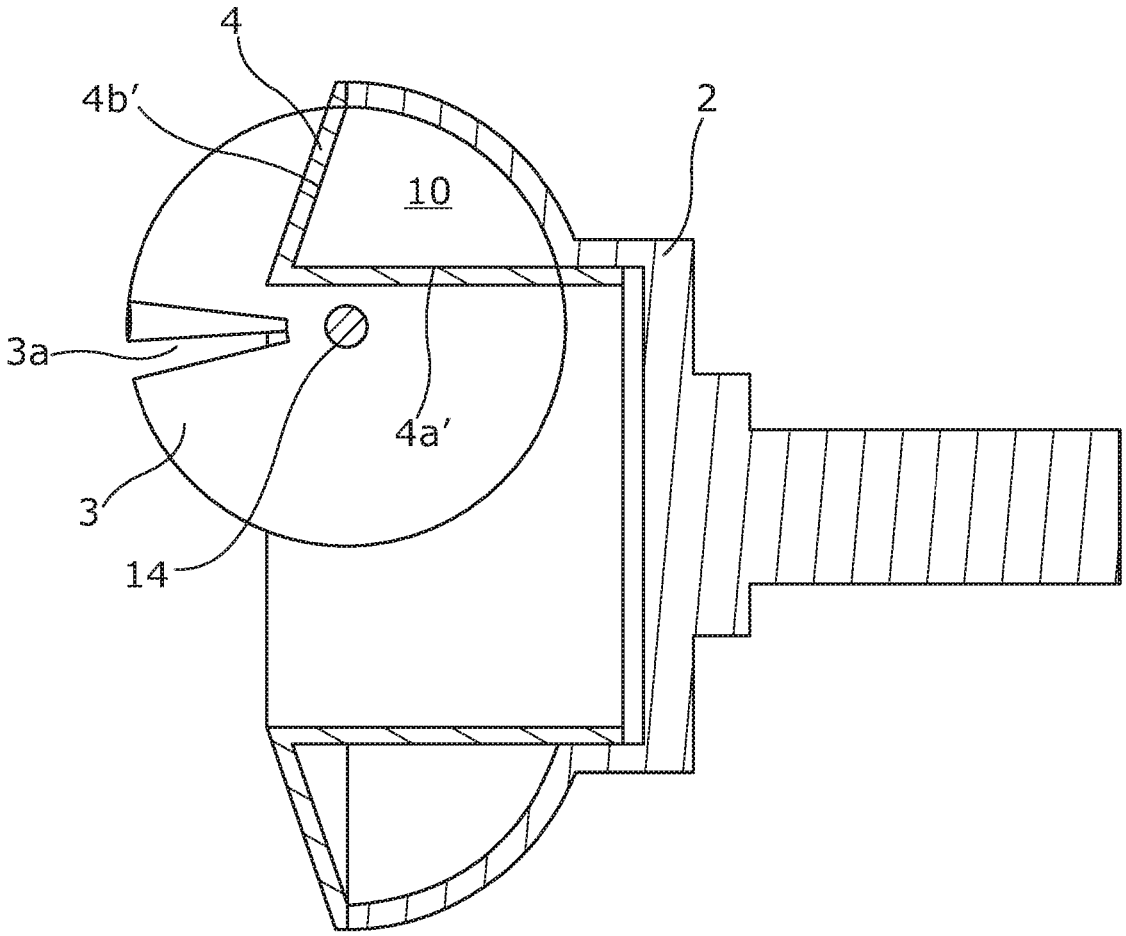

FIG. 7 shows an alternative embodiment of a first type of rotary piston and cylinder device. Here the stator 4 is shown to comprise a single part, which forms two internal surfaces 4*a*' and 4*b*' in a similar fashion to the device shown in FIG. 2. The different orientation of the surface 4*b*', however, allows for a greater volume of the working chamber 10 without alteration to the rotor 2 or other components of the assembly. This is achieved by the face 4*b* having a non-orthogonal orientation to face 4*a*' when viewed in cross-section. Face 4*b*' may be viewed as a frusto-conical surface around the axis of rotation of the rotor.

Figure 8:
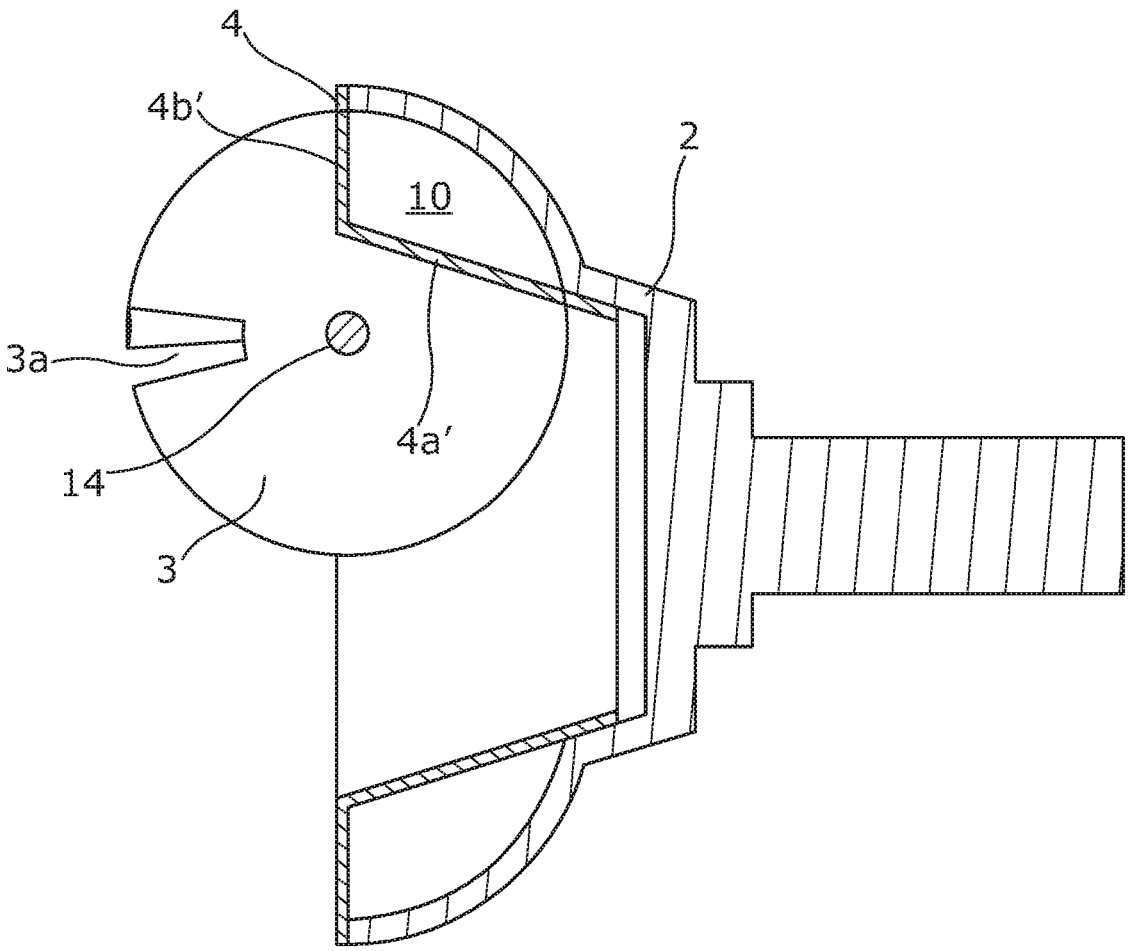

FIG. 8 shows a further possible embodiment. Similarly to FIG. 7, one of the surfaces of the stator 4 which defines the chamber 10 can be thought of as frusto-conical. In this particular embodiment surface 4*a*' is substantially frusto-conical and surface 4*b*' is substantially planar 9 or straight in cross-section). This arrangement may be proffered to allow more space for transmission elements, such as gears, interacting with shaft 14 of the shutter disc 3.

Figure 9:
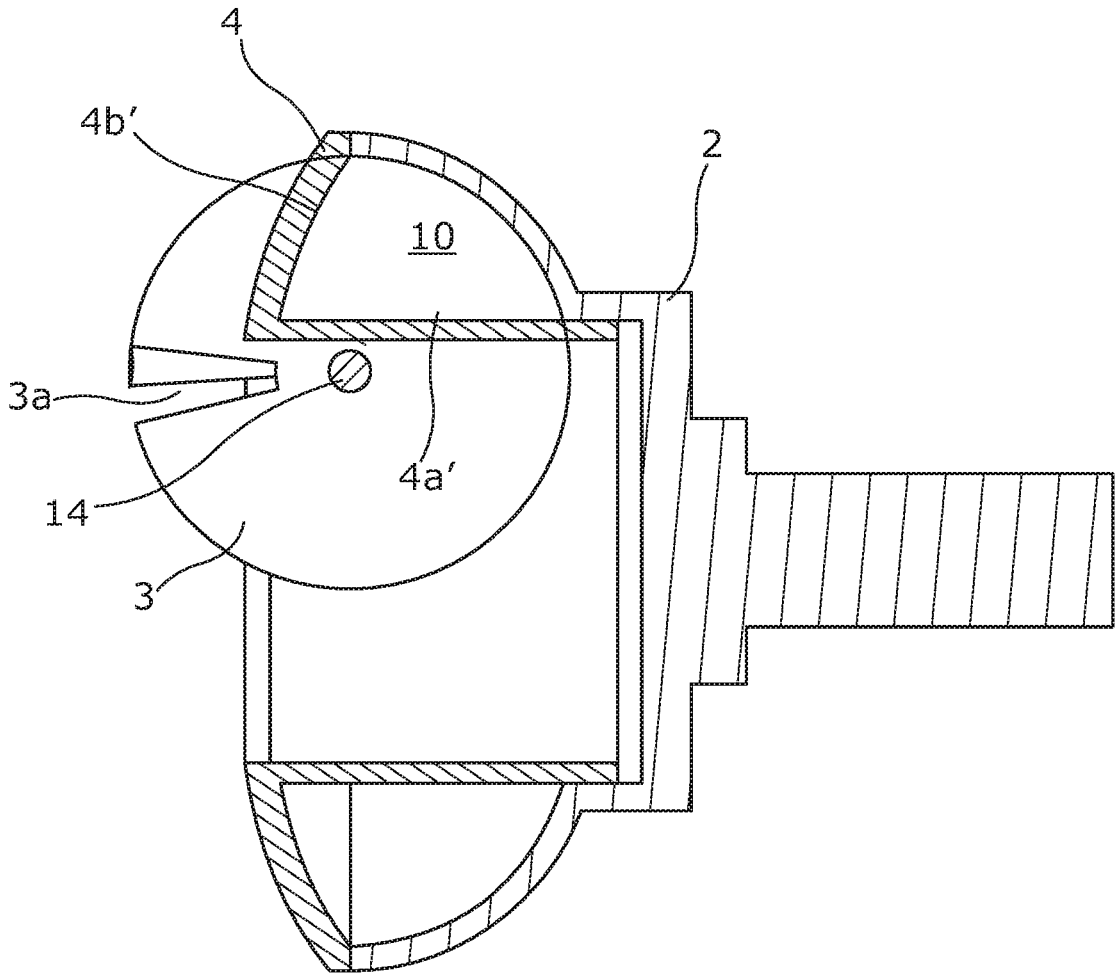

FIG. 9 shows yet another possible embodiment, which can be considered a variation of the device in FIG. 7. Here the stator 4 also comprises faces 4*a*' and 4*b*', but the face 4*b*' is curved in cross-section. This can be considered to form a curved or dished annular surface. While such a surface can be more costly to machine and inspect, it allows for yet further volume increase of chamber 10 with minimal modifications to other components of the device.

It will be appreciated that alternative embodiments, embodying the same underlying principles to those embodied in the examples above, may include a single curved surface, but more than two straight/linear profile chamber-defining surfaces (when viewed in cross-section). It will also be appreciated that these alternative embodiments may be incorporated in machines of the type seen in FIGS. 4 to 6.

The invention claimed is:

1. A rotary piston and cylinder device comprising:

a rotor, a stator, a rotatable shutter, the rotor and the stator comprising surface portions which define a chamber into which the piston extends, wherein the chamber is a three-sided chamber defined by three surface portions as viewed in an axial cross-section of the chamber, wherein the rotor comprises a first surface portion and the stator comprises a second surface portion and a third surface portion of said three-sided chamber, and wherein the second surface portion and the third surface portion of the stator neighbor each other.

2. A rotary piston and cylinder device as claimed in claim 1 in which the second and the third surface portions are linear surface portions defining the chamber.

3. A rotary piston and cylinder device as claimed in claim 1 in which the axial cross-section of the chamber is taken along a plane that includes an axis of rotation of the rotor being disposed therein.

4. A rotary piston and cylinder device as claimed in claim 1 in which one of the second surface portion or the third surface portion of the stator, when viewed in the axial cross-section of the chamber, is substantially linear.

5. A rotary piston and cylinder device as claimed in claim 1 in which the second and the third surface portions, when viewed in the axial cross-section of the chamber, are each substantially linear.

6. A rotary piston and cylinder device as claimed in claim 1 in which the second and third surface portions, when viewed in the axial cross-section of the chamber, subtend an angle in range of 10 to 170 degrees.

7. A rotary piston and cylinder device as claimed in claim 1 in which the second and the third surface portions, when viewed in the axial cross-section of the chamber, are substantially orthogonal to each other.

8. A rotary piston and cylinder device as claimed in claim 1 in which the second and the third surface portions meet at, or are proximal to each other, at a junction region.

9. A rotary piston and cylinder device as claimed in claim 1 in which, when viewing the axial cross section of the chamber, the first surface portion of the rotor is curved.

10. A rotary piston and cylinder device as claimed in claim 1 in which the first surface portion of the rotor extends from or is proximal to a distal region of one of the second or the third surface portions of the stator, to or proximal to, a distal region of the other of the second or the third surface portions of the stator.

11. A rotary piston and cylinder device as claimed in claim 1 in which the second and the third surface portions comprise at least in part an annular surface portion and a cylindrical surface portion, respectively.

12. A rotary piston and cylinder device as claimed in claim 11 which the annular surface portion of the stator is substantially flat.

* * * * *